US006848346B1

(12) United States Patent
Panasik

(10) Patent No.: US 6,848,346 B1
(45) Date of Patent: Feb. 1, 2005

(54) HURRICANE SHUTTER FASTENER INSTALLATION BIT

(75) Inventor: Cheryl L. Panasik, Elburn, IL (US)

(73) Assignee: Illinois Tool Work Inc, Glenview, IL (US)

( * ) Notice: Subject to any disclaimer, the term of this patent is extended or adjusted under 35 U.S.C. 154(b) by 0 days.

(21) Appl. No.: 10/615,858

(22) Filed: Jul. 9, 2003

(51) Int. Cl.[7] ..... B25B 23/00
(52) U.S. Cl. ..... 81/438; 81/436
(58) Field of Search ..... 81/436, 438, 900

(56) References Cited

U.S. PATENT DOCUMENTS

| | | | | | |
|---|---|---|---|---|---|
| 2,917,954 | A | * | 12/1959 | Capelle | 81/436 |
| 3,965,510 | A | | 6/1976 | Ernst | |
| 4,107,800 | A | | 8/1978 | Jorgensen | |
| 5,431,075 | A | * | 7/1995 | Cruz et al. | 81/492 |
| 5,518,351 | A | | 5/1996 | Peil | |
| 5,555,781 | A | * | 9/1996 | Pool et al. | 81/436 |
| 6,223,375 | B1 | | 5/2001 | Vaughan, Jr. | |
| 6,282,998 | B1 | | 9/2001 | Beach | |
| 6,352,011 | B1 | * | 3/2002 | Fruhm | 81/438 |
| 6,363,819 | B1 | * | 4/2002 | Li | 81/438 |
| 6,443,680 | B1 | | 9/2002 | Bodin | |
| 6,494,121 | B1 | * | 12/2002 | Hu | 81/439 |
| 6,622,597 | B2 | * | 9/2003 | Chen | 81/58.3 |
| 6,655,243 | B2 | * | 12/2003 | Anderson et al. | 81/490 |
| 6,679,142 | B1 | * | 1/2004 | Lin | 81/437 |
| 6,725,749 | B1 | * | 4/2004 | Liou | 81/438 |
| 6,742,421 | B1 | * | 6/2004 | Chen | 81/490 |

FOREIGN PATENT DOCUMENTS

GB 2050900 A * 1/1981 ..... B25B/23/00

OTHER PUBLICATIONS

U.S. Appl. No. 10/213,795, Kolodziej, Norbert K., Bodin, Richard G. Mushrooming Expandable Anchor.

* cited by examiner

*Primary Examiner*—David B. Thomas
(74) *Attorney, Agent, or Firm*—Lisa M. Soltis; Mark W. Croll; Donald J. Breh

(57) ABSTRACT

A novel drive bit for mounting in a sleeve of a rotary driving tool for driving a slottedd screw having a hollow cap with a threaded interior cylindrical wall having an inner minor diameter comprises a driver portion at one end thereof and a sleeve engaging portion at the other end thereof, wherein the driver portion includes a generally cylindrical aligning portion with a predetermined diameter of between about 85% and about 99½% of the inner minor diameter and a pair of laterally opposed concave surfaces tapering at a predetermined radius of curvature of between about 50% and about 150% of the inner minor diameter to a generally rectangular flat headed tip for engaging the slot of the screw while the generally cylindrical aligning portion aligns the cap and the screw substantially coaxially with the bit.

3 Claims, 2 Drawing Sheets

HURRICANE SHUTTER FASTENER INSTALLATION BIT

BACKGROUND OF THE INVENTION

1. Field of the Invention

The present invention is directed to a bit for installing a fastener assembly forsecuring a member, particularly for a installing a fastener assembly in concrete or wood for securing hurricane shutters.

2. Description of the Related Art

Fasteners for securing hurricane shutters to concrete or wood have included a cap having interior threading for engaging with a bolt for securing the shutters during a hurricane. An example of such a hurricane fastener is the shutter screw sold under the trademark SAMMY SUPER SCREW, manufactured by Illinois Tool Works Buildex.

Typically, a counterbored hole is drilled into the concrete or wood to accommodate the cap and a tool is used to drive the fastener into the concrete. Prior attempts have used a tool with a threaded portion that engaged the interior threading of the cap. The threaded portion of the tool was engaged with the interior threading of the cap and the tool supplied the torque necessary to drive the fastener into the concrete. However, the high torque needed to drive the fastener into concrete caused the threaded portion of the tool and the interior threading of the fastener head to engage so tightly that when it was attempted to disengage the tool from the fastener, the fastener often would be forced in a disengaging direction and sometimes would fully disengage, partially strip out the concrete, or break, so that in some instances either the fastener or the drilled hole could not be reused.

What is needed is a tool that can install a fastener with a hollow threaded cap and that can easily be disengaged from the fastener, yet can provide enough strength to drive the fastener into concrete.

BRIEF SUMMARY OF THE INVENTION

A generally axial bit is provided for mounting in a sleeve of a rotary driving tool to drive a slotted screw having a hollow cap with a threaded interior cylindrical wall having an inner minor diameter. The novel bit includes a driver portion at one end and a sleeve engaging portion at the other end, wherein the driver portion includes a generally cylindrical aligning portion with a predetermined diameter of between about 85% and about 99½% of the inner minor diameter and a pair of laterally opposed concave surfaces tapering at a predetermined radius of curvature of between about 50% and about 150% of the inner minor diameter to a generally rectangular flat headed tip for engaging the slot of the screw while the generally cylindrical aligning portion aligns the cap and the screw substantially coaxially with the bit.

In a preferred embodiment, a generally axial bit is provided for engaging, aligning and driving a fastener assembly into concrete, the assembly including a slotted screw and a hollow cap, the slotted screw having a slot width of at least about 0.053 inch and the cup having a ¼ inch UNC 2B threaded interior cylindrical wall for subsequently receiving a ¼ inch UNC 2B bolt to releasably secure a member to the fastener assembly. The bit is mountable in a sleeve of a rotary driving tool, the sleeve having a generally hexagonal interior with a detent. The novel bit includes a driver portion at one end and a sleeve engaging portion at the other end, wherein the sleeve engaging portion is hexagonal and has a recess for receiving the detent, the driver portion includes a generally cylindrical aligning portion with a diameter of between about 0.17 inch and about 0.19 inch and a pair of laterally opposed concave surfaces tapering at a predetermined radius of curvature of between about 3/32 inch and about 7/32 inch to a generally rectangular flat headed tip having a thickness of about 0.052 inch, wherein the tip is engageable with the slot of the screw when the generally cylindrical aligning portion aligns the cap and the screw substantially with the bit.

In one embodiment, the bit is made of heat treated S5 steel hardened to a Rockwell C hardness of between about 55 and about 60 and wherein the concave surfaces of the driving portion have a radius of curvature of about 3/16 inch.

DETAILED DESCRIPTION OF THE INVENTION

Figure 1:
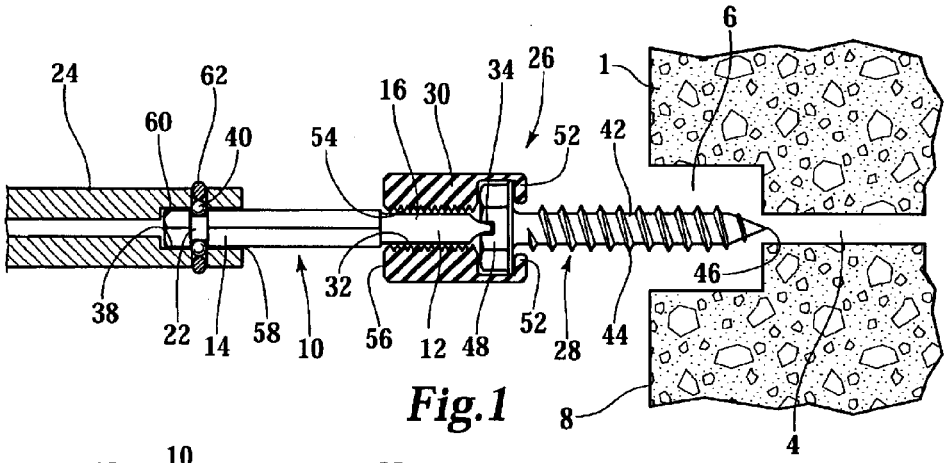
FIG. 1 is a partial side-sectional view of a bit of the present invention for driving a fastener assembly into a concrete or wood substrate.
Figure 3:
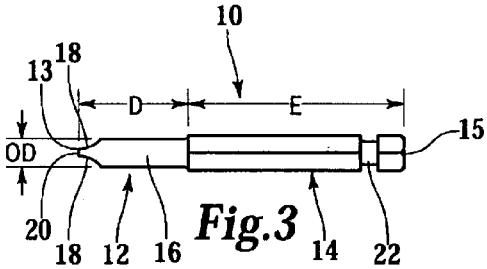
FIG. 3 is an elevation view of the bit of the present invention.
Figure 9:
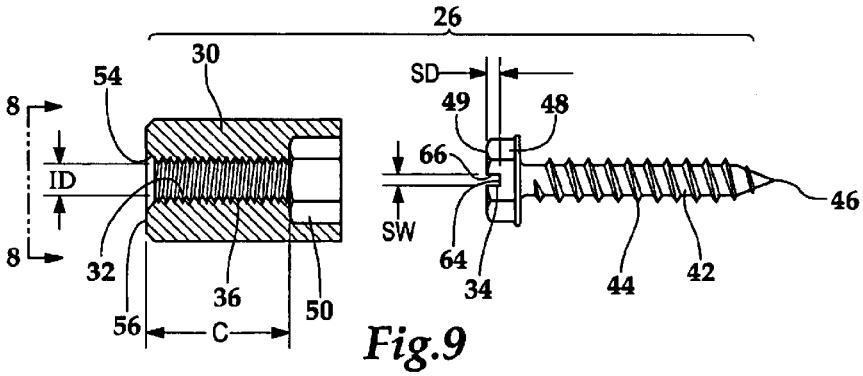
FIG. 9 is an exploded side-sectional view of the fastener assembly.

Referring to FIGS. 1, 3, and 9, a generally axial bit 10 is shown for mounting in a sleeve 24 of a rotary driving tool in order to drive a slotted screw 28 having a hollow cap 30 with a threaded interior cylindrical wall 32 having an inner minor diameter ID into a concrete or wood substrate 1. Bit 10 includes a driver portion 12 at a driving end 13 and a sleeve engaging portion 14 at a trailing end 15. Driver portion 12 includes a generally cylindrical aligning portion 16 having a predetermined diameter OD of between about 85% and about 99.5% of inner minor diameter ID and a pair of laterally opposed concave tapered surfaces 18 tapering at a predetermined radius of curvature R of between about 50% and about 150% of inner minor diameter ID to a generally rectangular flat headed tip 20 for engaging a slot 34 of screw 28 while aligning portion 16 aligns cap 30 and screw 28 substantially coaxially with bit 10.

Screw 28 and cap 30 form a fastener assembly 26 that is driven into concrete or wood substrate 1. In one embodiment, slot 34 has a width SW of at least about 0.053 inch and threaded interior cylindrical wall 32 of cap 30 includes ¼ inch Unified National Coarse (UNC) Class 2B threads 36 for subsequently receiving a ¼ inch UNC 2B bolt to releasably secure a member, such as a hurricane shutter, to fastener assembly 26. Sleeve 24 of the tool can have a generally hexagonal interior surface 38 with a detent 40 for engaging bit 10, wherein sleeve engaging portion 14 can be hexagonal to complement hexagonal interior surface 38 and can include a recess 22 for receiving detent 40.

Fastener Assembly

Continuing with FIGS. 1 and 9, fastener assembly 26 includes screw 28 having a shank 42 with threads 44, there being a point 46 at one end of shank 42 and a head 48 at the opposite end of shank 42. A generally cylindrical cap 30 is coupled with head 48 to form fastener assembly 26. Cap 30 includes a counterbore 50 which accepts head 48, and a portion of cap 30 is swaged to form a lip 52 around head 48 which tightly and securely joins head 48 and cap 30 to form fastener assembly 26.

Cap 30 includes an interior cylindrical wall 32 having threads 36 for engaging a bolt (not shown) for securing hurricane shutters (not shown) to substrate 1. Threaded interior cylindrical wall 32 allows a bolt to be removable with a reduced chance of causing damage to substrate 1 because fastener assembly 26 remains installed within substrate 1 while the bolt can be repeatedly engaged, disengaged or replaced. In one embodiment, cap 30 includes a bevel 54 between a top surface 56 and interior cylindrical wall 32, see FIG. 9, which helps guide tip 20 of bit 10 more easily into interior cylindrical wall 32.

The inner minor diameter ID of threaded interior cylindrical wall 32 between crests of threads 36 is selected to accommodate the bolt being used to secure the hurricane shutters. The length C of interior cylindrical wall 32 is selected so that a predetermined length of the bolt will be engaged with threads 36 for a predetermined strength securing the hurricane shutters. In one embodiment, inner diameter ID is between about 0.19 inch and about 0.20 inch and the length C of interior cylindrical wall 32 is between about 0.4 inch and about 0.9 inch, preferably about ½ inch. In one embodiment, threads 36 of interior cylindrical wall 32 are ¼ inch UNC 2B threads having a minimum minor diameter ID of about 0.196 inch and a maximum minor diameter of about 0.207 inch.

Continuing with FIG. 9, in one embodiment, a conventional concrete screw 28 is used such as concrete fasteners manufactured by Illinois Tool Works Buildex and sold under the trademark TAPCON. Additional fasteners and methods of manufacture are disclosed in U.S. Pat. No. 5,518,351 to Peil and U.S. Pat. No. 6,443,680 to Bodin, both assigned to the assignee of this application, the disclosures of which are incorporated herein by reference.

Figure 8:
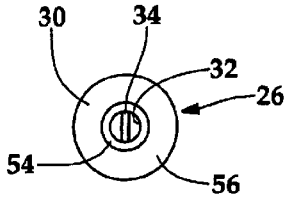
FIG. 8 is an elevation view of the fastener assembly.

Head 48 includes a slot 34 in a top surface 49 for receiving tip 20 of bit 10. Slot 34 is generally laterally centered in interior cylindrical wall 32 of cylindrical head 30 so that slot 34 spans the diameter of interior cylindrical wall 32, best seen in FIG. 8. In one embodiment, slot 34 has a width SW of between about 0.05 inch and about 0.07 inch, preferably between about 0.053 inch and about 0.065 inch and a depth SD of between about 0.07 inch and about 0.11 inch, preferably between about 0.077 inch and about 0.103 inch.

Referring back to FIG. 1, before fastener assembly 26 is driven into the concrete or wood substrate 1 a hole 4 having a counterbore 6 is drilled in concrete or wood substrate 1, as shown in FIG. 1. The diameter of hole 4 is slightly smaller than the diameter of shank 42 so that threads 44 can tap and engage concrete or wood substrate 1 and the diameter of counterbore 6 is slightly larger than the outer diameter of cap 30. Counterbore 6 is drilled to a depth that allows top surface 56 of cap 30 to be essentially flush with the surface 8 of substrate 1. In one embodiment, hole 4 is drilled for both shank 42 and cap 30 using a step drill so that hole 4 and counterbore 6 can be drilled in one step.

Sleeve

Continuing with FIG. 1, sleeve 24 can be part of a drill (not shown) or a socket (not shown), but preferably bit 10 is mounted within the sleeve of an adapter that allows a rotary driving tool to be used to both drill hole 4 and drive fastener assembly 26, such as the adapter manufactured by Illinois Tool Works Buildex and sold under the trademark CONDRIVE. Sleeve 24 includes an opening 58 for receiving bit 10, wherein opening 58 includes an interior engagement surface 38 for engaging with and imparting torque to bit 10. Interior engagement surface 38 has a cross sectional shape that complements the shape of sleeve engaging portion 14, such as a hexagonal shape to complement the hexagonal cross section of sleeve engaging portion 14 shown in FIG. 7. In one embodiment, sleeve 24 includes a shoulder 60 which trailing end 15 can abut against to ensure that bit 10 does not extend past a desired point into sleeve 24. Sleeve 24 can also include a detent 40 in interior engagement surface 38 for engaging recess 22, described below, to retain bit 10 in a desired position. In one embodiment, detent 40 is a ball bearing that is urged radially inwardly by a corresponding resilient elastic band 62.

Examples of other drilling and fastener driving tools are disclosed in U.S. Pat. No. 3,965,510 to Ernst, U.S. Pat. No. 6,223,375 to Vaughan and U.S. Pat. No. 6,282,998 to Beach, all assigned to the assignee of this application, the disclosure of which is incorporated herein by reference.

Bit

Bit 10 includes a driver portion 12 at a driving end 13 and a sleeve engaging portion 14 at a trailing end 15. In one embodiment, bit 10 is manufactured from hardened metal, such as S5 steel that has been heat treated to a Rockwell C hardness of between about 55 and about 60.

Driver Portion

Driver portion 12 includes a generally cylindrical aligning portion 16 and a pair of laterally opposed concave tapered surfaces 18 that taper at a predetermined radius of curvature R to a generally rectangular flat headed tip 20 at driving end 13 for engaging with slot 34.

Figure 2:
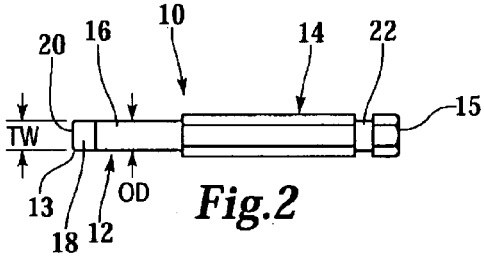
FIG. 2 is a plan view of the bit of the present invention.
Figure 4:
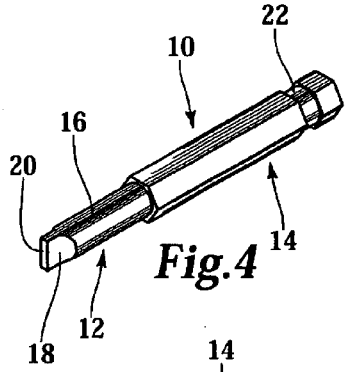
FIG. 4 is a perspective view of the bit of the present invention.

Turning to FIGS. 1 and 2, aligning portion 16 aligns screw 28 and cap 30 so they are substantially coaxial with bit 10 and aligning portion 16 helps to guide tip 20 within interior cylindrical wall 32 so that tip 20 is engageable with slot 34. Aligning portion 16 is generally cylindrical in shape, which includes a substantially cylindrical shape and approximations thereof. For example, aligning portion 16 can be made up of many sided shapes, for example a cross-section having 6, 8 or 15 sides, so long as aligning portion 16 serves its intended function of aligning cap 30 with bit 10 by substantially filling at least two spaced cross-sections of the interior of cap 30.

The outer diameter OD of aligning portion 16 is selected so that aligning portion 16 will complement interior cylindrical wall 32 so that there is a very close alignment between the outer surface of aligning portion 16 and the crests of threads 36. This alignment ensures that as bit 10 is inserted into cap 30, aligning portion 16 and interior cylindrical wall 32 remain substantially aligned with one another so that bit 10 and screw 28 and cap 30 are substantially coaxial with one another.

The alignment of aligning portion 16 and interior cylindrical wall 32 ensures that the driving surface of tip 20 remains substantially parallel to the bottom surface 64 of slot 34. The alignment also ensures that tapered surfaces 18 at driving end 13 are generally parallel to side surfaces 66 of slot 34 so that tapered surfaces 18 can provide force against side surfaces 6 substantially along the entire length of slot 34. Slightly misaligned driving tips have been known to break more easily because of unbalanced forces, especially at the high torques required to drive fasteners into concrete.

The diameter OD of aligning portion 16 is selected to be between about 85% and about 99.5% of the inner minor diameter ID, preferably between about 95% and about 98%, still more preferably about 97% of inner minor diameter ID. In one embodiment, wherein threads 36 are ¼ inch UNC 2B threads with an inner minor diameter ID of between about 0.196 inch and about 0.207 inch, the outer diameter OD of aligning portion 16 is between about 0.17 inch and about 0.195 inch, preferably between about 0.17 inch and about 0.19 inch, still more preferably about 0.19 inch.

Figure 5:
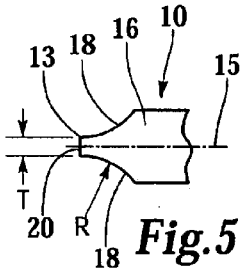
FIG. 5 is an enlarged plan view of a generally rectangular flat headed tip of the bit.

Turning to FIG. 5, tapered surfaces 18 gradually decrease in width at a predetermined radius of curvature R from aligning portion 16 toward generally rectangular flat headed tip 20, so that tip 20 is narrow enough to complement and fit snugly within slot 34.

Tapered surfaces 18 spread the stress associated with driving fastener assembly 26 out along the curves of tapered surfaces 18 so that they brace bit 10 against the torsion forces created by driving fastener assembly 26, resisting breaking of bit 10. For this reason, a large radius of curvature R is generally preferred so that the stress can be spread out along a longer curve. However, there is a practical limit to how large the radius of curvature R can be because the larger the radius of curvature R, the more likely that bit 10 will break. The radius of curvature R is between about 50% and about 150% of inner minor diameter ID, preferably about 75% to about 125%, still more preferably about 95% of inner minor diameter ID. In one embodiment, radius of curvature R is between about 3/32 inch and about 7/32 inch, preferably about 5/32 to about 7/32, still more preferably 3/16 inch. Preferably, each tapered surface 18 tapers at generally the same radius of curvature R so that tapered surfaces 18 are generally symmetrical about a bisecting plane 15, shown in FIG. 5.

If, during an attempt to install fastener assembly 26, bit 10 does not transfer enough torque to drive fastener assembly 26, tapered surfaces 18 help prevent bit 10 from breaking because tapered surfaces 18 tend to cause bit 10 to cam out of slot 34 before bit 10 will break. Although camming out is generally undesirable, it is preferable for bit 10 to cam out of slot 34 rather than breaking due to an overloading torsion force.

The thickness T of tip 20 is selected so that at the high torque required to drive fastener assembly 26 into concrete 1, tip 20 is thick enough to provide adequate strength to prevent bit 10 from breaking while still being thin enough to allow tip 20 to fit within slot 34. Tip thickness T preferably is between about 0.0005 inch and about 0.003 inch, preferably about 0.001 inch less than width SW of slot 34. In one embodiment, wherein the width SW of slot 34 is between about 0.053 inch and about 0.065 inch, the thickness T of tip 24 is preferably about 0.052 inch.

The width TW of tip 20 should be as large as is feasible to maximize engagement between tip 20 and slot 34, while still being small enough to fit within internal cylindrical wall 32 of cap 30. Preferably, the width of tip 20 is substantially equal to the diameter OD of aligning portion 16, to maximizing strength while avoiding fault lines and corresponding risk of breakage and for ease of manufacturing, for example by simply cutting or grinding away the radius of curvature R from opposite lateral sides of driving end 13 of bit 10.

The length D of driver portion 12 must be long enough so that tip 20 will engage slot 34. In one embodiment, wherein the interior length C of threaded cylinder 32 is between about ½ inch and about 0.75 inch, the length D of driver portion 12 is between about 0.76 inch and about 0.77 inch, preferably about 0.765 inch.

Sleeve Engaging Portion

Figure 7:
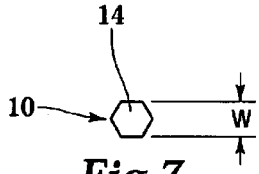
FIG. 7 is an end view of the trailing end of the bit.

Sleeve engaging portion 14 has a length E between trailing end 15 and aligning portion 16. Preferably, sleeve engaging portion 14 has a cross section that is generally hexagonal, as in FIG. 7, to complement interior engagement surface 38 of sleeve 24. The width across sleeve engaging portion 14 is sized to fit within sleeve 24. In one embodiment, the lateral width W across the flats of hexagonal sleeve engaging portion 14, shown in FIG. 7, is between about 0.245 inch and about 0.255 inch, preferably between about 0.248 inch and about 0.25 inch The length E of sleeve engaging portion 14 is selected to ensure that when bit 10 is engaged with sleeve 24 at least a portion of sleeve engaging portion 14 extends out of opening 58, as shown in FIG. 1, to ensure that sleeve 24 does not interfere with cap 30 as bit 10 drives fastener assembly 26.

Figure 6:
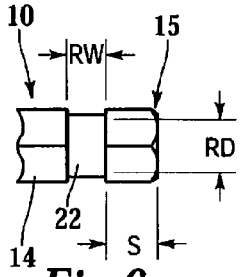
FIG. 6 is an enlarged plan view of a trailing end of the bit.

Turning to FIG. 6, a recess 22 can be included in sleeve engaging portion 14 for engaging with detent 40 in sleeve 24. The width RW of recess 22 is selected so that recess is wide enough to receive detent 40, yet not so wide as to significantly weaken bit 10. The diameter RD of recess 22 is sized so that the depth of recess 22 relative to sleeve engaging portion 14 is deep enough that detent 40 can settle into recess 22 and retain bit 10. In one embodiment, the width RW of recess 22 is between about 0.1 inch and about 0.15 inch, preferably about 0.12 inch and the diameter RD of recess is between about 0.24 inch and about 0.25 inch, preferably about 0.245 inch.

Preferably, recess 22 is generally annular in shape so that sleeve engaging portion 14 can be inserted into sleeve 24 in one of several rotational orientations and detent 40 will still be able to engage recess 22.

Recess 22 is spaced along sleeve engaging portion 14 from trailing end 15 by a distance S that complements the distance between a shoulder 66 and detent 40 in sleeve 24 so that when trailing end 15 abuts shoulder 60, recess 22 will be aligned with detent 40. In one embodiment, the distance S is between about 0.15 inch and about 0.2 inch, preferably about 0.18 inch.

The bit of the present invention allows a fastener assembly of a slotted screw and a hollow cap with a threaded interior cylindrical wall to be driven into concrete with reduced risk of breaking the bit, and allows for easy disengagement of the bit with the fastener.

While the foregoing written description of the invention enables one of ordinary skill to make and use what is considered presently to be the best mode thereof, those of ordinary skill will understand and appreciate the existence of variations, combinations, and equivalents of the specific exemplary embodiment herein. The invention should therefore not be limited by the above described embodiment, but by all embodiments within the scope and spirit of the invention.

What is claimed is:

1. A generally axial bit for mounting in a sleeve of a rotary driving tool in order to drive a slotted screw having a hollow cap with a threaded interior cylindrical wall having an inner minor diameter, said bit comprising:

a driver portion at one end thereof and a sleeve engaging portion at the other end thereof;

said driver portion including a generally cylindrical aligning portion with a predetermined diameter of between about 85% and about 99½% of said inner minor diameter and a pair of laterally opposed concave surfaces tapering at a predetermined radius of curvature of between about 50% and about 150% of said inner minor diameter to a generally rectangular flat headed tip for engaging the slot of said screw while said generally cylindrical aligning portion aligns said cap and said screw substantially coaxially with said bit.

2. A generally axial bit for engaging, aligning and driving a fastener assembly into concrete, said assembly including a slotted screw and a hollow cap, said slotted screw having a slot width of at least about 0.053 inch and said cap having a ¼inch UNC-2B threaded interior cylindrical wall for subsequently receiving a ½ inch UNC-2B bolt to releasably secure a member to said fastener assembly, said bit being mountable in a sleeve of a rotary driving tool, said sleeve having a generally hexagonal interior with a detent, said generally axial bit comprising:

a driver portion at one end thereof and a sleeve engaging portion at the other end thereof;

said sleeve engaging portion being hexagonal and having a recess for receiving said detent;

said driver portion including a generally cylindrical aligning portion with a diameter of between about 0.17 inch and about 0.19 inch and a pair of laterally opposed concave surfaces tapering at a predetermined radius of curvature of between about 3⁄32 inch and about 7⁄32inch to a generally rectangular flat headed tip having a thickness of about 0.052 inch, wherein said tip is engageable with the slot of said screw when said generally cylindrical aligning portion aligns said cap and said screw substantially coaxially with said bit.

3. A bit according to claim 2, wherein said bit is made of heat treated S5 steel hardened to a Rockwell C hardness of between about 55 and about 60 and wherein said concave surface of said driving portion have a radius of curvature of about 3⁄16 inch.

* * * * *

UNITED STATES PATENT AND TRADEMARK OFFICE

CERTIFICATE OF CORRECTION

PATENT NO. : 6,848,346 B1
APPLICATION NO. : 10/615858
DATED : February 1, 2005
INVENTOR(S) : Panasik It is certified that error appears in the above-identified patent and that said Letters Patent is hereby corrected as shown below:

Title page item (73) Assignee: please delete "Illinois Tool Work Inc." and insert -- Illinois Tool Works Inc. --.

Title page item (57) Abstract line 2: please delete "slottedd" and insert -- slotted --.

Signed and Sealed this

Fourth Day of March, 2008

JON W. DUDAS
*Director of the United States Patent and Trademark Office*